US010328692B2

(12) United States Patent
Tomimatsu

(10) Patent No.: US 10,328,692 B2
(45) Date of Patent: Jun. 25, 2019

(54) LIQUID EJECTION HEAD AND LIQUID EJECTION APPARATUS

(71) Applicant: SEIKO EPSON CORPORATION, Tokyo (JP)

(72) Inventor: Shingo Tomimatsu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/913,255

(22) Filed: Mar. 6, 2018

(65) Prior Publication Data

US 2018/0264830 A1 Sep. 20, 2018

(30) Foreign Application Priority Data

Mar. 15, 2017 (JP) ..... 2017-049898

(51) Int. Cl.
*B41J 2/14* (2006.01)
*B41J 2/045* (2006.01)

(52) U.S. Cl.
CPC ..... *B41J 2/04581* (2013.01); *B41J 2/14233* (2013.01); *B41J 2002/14306* (2013.01)

(58) Field of Classification Search
CPC ..... B41J 2/04581; B41J 2/14233; B41J 2002/14306
See application file for complete search history.

(56) References Cited

U.S. PATENT DOCUMENTS

2012/0092408 A1 4/2012 Yamamori et al.
2016/0279938 A1 9/2016 Takino et al.

FOREIGN PATENT DOCUMENTS

EP 1541362 6/2005
JP 2016-182811 A 10/2016
WO 2016152166 9/2016

OTHER PUBLICATIONS

European Search Report for EP Application No. 18158942 dated Jul. 27, 2018.

*Primary Examiner* — Julian D Huffman
(74) *Attorney, Agent, or Firm* — Workman Nydegger

(57) ABSTRACT

A liquid ejection head, which includes a driving element that changes pressure in a pressure chamber and causes a liquid to be ejected from a nozzle, an individual channel that communicates with the pressure chamber, and a liquid reservoir that supplies via the individual channel the liquid introduced from an inlet to the pressure chamber. The liquid reservoir includes a first reservoir disposed on the inlet side, a second reservoir disposed on the individual channel side, and an intermediate reservoir that communicates with the first reservoir and the second reservoir. At least a part of the first reservoir overlaps the second reservoir when seen in plan view. A first compliance substrate is provided in the first reservoir on the second reservoir side on the side opposite to the inlet. A second compliance substrate is provided in the second reservoir on the side opposite to the first reservoir.

20 Claims, 8 Drawing Sheets

LIQUID EJECTION HEAD AND LIQUID EJECTION APPARATUS

The entire disclosure of Japanese Patent Application No. 2017-049898, filed Mar. 15, 2017 is expressly incorporated by reference herein.

BACKGROUND

1. Technical Field

The invention relates to technique for ejecting a liquid, such as ink.

2. Related Art

A liquid ejection head which ejects, from a nozzle, a liquid, such as ink supplied to a plurality of pressure chambers from a liquid reservoir (a reservoir) by generating pressure in each of the pressure chambers has been proposed. For example, JP-A-2016-182811 discloses a technique for forming an opening on the same side as that of an inlet of a liquid reservoir and sealing the opening with a flexible compliance substrate. According to this configuration, pressure variation in the liquid reservoir caused by a liquid introduced from the inlet of the liquid reservoir is accommodated by the compliance substrate, and the influence of the pressure variation does not extend as far as each pressure chamber.

SUMMARY

If pressure variation in the liquid reservoir is to be accommodated by a compliance substrate as disclosed in JP-A-2016-182811, the effect of accommodating the pressure variation in the liquid reservoir increases as the area of an active part that is a portion of the compliance substrate to be deformed increases. However, in the configuration of JP-A-2016-182811, since the compliance substrate is disposed on the same side as that of the inlet, an active part of the compliance substrate needs to be disposed so as not to interfere with the inlet so that a metal part of the inlet is not deformed. Therefore, an area and a form of the active part of the compliance substrate will be limited by the position and the size of the inlet. An advantage of some aspects of the invention is to improve the effect of accommodating the pressure variation caused by a liquid irrespective of the position of the inlet.

A liquid ejection head of the invention includes a driving element that changes pressure in a pressure chamber and causes a liquid to be ejected from a nozzle, an individual channel that communicates with the pressure chamber, and a liquid reservoir that supplies via the individual channel the liquid introduced from an inlet to the pressure chamber. The liquid reservoir includes a first reservoir disposed on the inlet side, a second reservoir disposed on the individual channel side, and an intermediate reservoir that communicates with the first reservoir and the second reservoir. At least a part of the first reservoir overlaps the second reservoir when seen in a plan view. A first compliance substrate is provided in the first reservoir on the second reservoir side on the side opposite to the inlet. A second compliance substrate is provided in the second reservoir on the side opposite to the first reservoir. According to the above aspect, since the first compliance substrate is provided in the first reservoir on the inlet side on the side opposite to the second reservoir, an area of an active part of the first compliance substrate can be increased irrespective of the position and the size of the inlet as compared with a case in which the compliance substrate is provided on the same side as that of the inlet. Thus, according to this aspect, the effect of accommodating the pressure variation caused by a liquid can be improved irrespective of the position of the inlet. Since the first compliance substrate is provided in the first reservoir on the side opposite to the inlet, the first compliance substrate can be disposed such that the liquid introduced from the inlet may hit the first compliance substrate, therefore, pressure of the liquid is transmitted to the first compliance substrate easier than a case in which the first compliance substrate is provided on the same side as that of the inlet. Therefore, pressure variation caused by the liquid introduced from the inlet is easily accommodated by the first compliance substrate. Since the second compliance substrate is provided in the second reservoir disposed on the individual channel side on the side opposite to the first reservoir, the second compliance substrate is disposed at a position closer to the pressure chamber than the first compliance substrate. Therefore, pressure variation of the pressure chamber transmitted to the second reservoir via the individual channel is effectively accommodated by the second compliance substrate. Therefore, according to this aspect, since pressure variation caused by the liquid can be effectively accommodated, ejection stability of the liquid from the nozzle can be improved. Since at least a part of the first reservoir overlaps the second reservoir when seen in a plan view, the size of the liquid ejection head can be reduced.

In a desirable aspect of the invention, at least a part of the first compliance substrate overlaps the second compliance substrate when seen in a plan view. According to this aspect, since at least a part of the first compliance substrate overlaps the second compliance substrate when seen in a plan view, the size of the liquid ejection head can be reduced as compared with a case in which a part of the first compliance substrate does not overlap the second compliance substrate.

In a desirable aspect of the invention, the Young's modulus of the second compliance substrate is equal to or lower than the Young's modulus of the first compliance substrate. According to this aspect, since the Young's modulus of the second compliance substrate which is easier to accommodate the pressure variation of the pressure chamber is set to be equal to or lower than the Young's modulus of the first compliance substrate which is easier to accommodate the pressure variation caused by the introduction of a liquid from the inlet, the second compliance substrate can be made softer than the first compliance substrate. In this manner, the pressure variation of the pressure chamber which is minuter than the pressure variation caused by introduction of the liquid from the inlet can be more easily accommodated by the second compliance substrate.

In a desirable aspect of the invention, a thickness of the second compliance substrate is equal to or smaller than a thickness of the first compliance substrate. According to this aspect, the second compliance substrate can be set to be softer than the first compliance substrate by setting a thickness of the second compliance substrate to be equal to or smaller than a thickness of the first compliance substrate. In this manner, the pressure variation of the pressure chamber which is minuter than the pressure variation caused by introduction of the liquid from the inlet can be more easily accommodated by the second compliance substrate.

In a desirable aspect of the invention, the pressure chamber overlaps both the first reservoir and the first compliance substrate when seen in a plan view. According to this aspect, the size of the liquid ejection head can be reduced as compared with a case in which the pressure chamber does not overlap both the first reservoir and the first compliance substrate when seen in a plan view.

A desirable aspect of the invention includes a driving IC that drives the driving element, and the driving IC overlaps both the pressure chamber and the first compliance substrate when seen in a plan view. According to this aspect, the size of the liquid ejection head can be reduced as compared with a case in which the driving IC does not overlap both the pressure chamber and the first compliance substrate when seen in a plan view.

A desirable aspect of the invention includes a case member in which the liquid reservoir is formed. The case member includes a first case member in which the first reservoir is formed, and a second case member in which the intermediate reservoir is formed. The first case member and the second case member are stacked such that at least a part of the first reservoir overlaps the second reservoir when seen in a plan view. The first compliance substrate is provided between the first case member and the second case member. According to this aspect, Since the first compliance substrate is provided between the first case member and the second case member, the active part of the first compliance substrate is not exposed to the outside of the first case member and the second case member. Therefore, as compared with a case in which the first compliance substrate is exposed to the outside of the first case member and the second case member, evaporation of moisture content can be suppressed, and it is easy to take measures to suppress evaporation of moisture content. In this aspect, since the case member is divided into the first case member and the second case member, and the first reservoir is formed in the first case member. Therefore, by forming the first case member by a material which is easy to process than the second case member, the shape of a ceiling of the first reservoir RB can be easily changed. Dischargeability of air bubbles which easily move upward can be improved by forming the shape of a corner of the ceiling of the first reservoir into a curved surface shape along a flow of the ink, and the like, for example. Since a flow velocity of ink necessary for the discharge of air bubbles can be lowered by improving dischargeability of air bubbles, waste of ink can be reduced. Since the first case member and the second case member are divided, a first reservoir of a different shape or a first reservoir having different functions, for example, may be used easily by simply replacing the first case member.

In a desirable aspect of the invention, a damper chamber is provided in the second case member on the side opposite to the first reservoir via the first compliance substrate. According to this aspect, a damper chamber is provided in the second case member on the side opposite to the first reservoir via the first compliance substrate. With the pressure in the direction in which the liquid flows into the first reservoir from the inlet, the first compliance substrate can be bent toward the damper chamber. Therefore, the pressure variation of the liquid which flows into the first reservoir from the inlet can be controlled effectively.

In a desirable aspect of the invention, the length of an active part of the first compliance substrate which is to be deformed is longer than an opening width of the inlet. According to this aspect, since the length of the active part of the first compliance substrate is longer than the opening width of the inlet, the area of the active part becomes larger than the opening width of the inlet, and deformation of the active part can be made larger. Therefore, pressure variation of the ink is more easily accommodated by the first compliance substrate.

In a desirable aspect of the invention, the first compliance substrate overlaps the inlet when seen in a plan view. According to this aspect, since the first compliance substrate overlaps the inlet when seen in a plan view, the ink introduced from the inlet easily hits the first compliance substrate. Therefore, pressure of the liquid is easily transmitted to the first compliance substrate, and the pressure variation caused by the liquid introduced from the inlet is more easily accommodated by the first compliance substrate.

In a desirable aspect of the invention, the first compliance substrate is a composite member of a flexible film and a metallic member. According to this aspect, since the first compliance substrate is a composite member of a flexible film and a metallic member, the first compliance substrate itself may have rigidity.

In a desirable aspect of the invention, the first compliance substrate is a single member containing no metallic member. According to this aspect, since the first compliance substrate is a single member containing no metallic member, the first compliance substrate itself may have no rigidity. In this aspect, since the first compliance substrate is disposed in the first reservoir on the side opposite to the inlet, the first compliance substrate can be formed separately from the inlet. Therefore, it is not necessary to provide rigidity to the first compliance substrate itself by integrating the metallic member which forms the inlet and the first compliance substrate as a component module. Therefore, by setting the first compliance substrate as a single part, the number of parts can be reduced.

In a desirable aspect of the invention, the first compliance substrate is disposed between an opening of the second reservoir and an opening of the damper chamber that face each other, fixed to the second case member, and is not fixed to the first case member. According to this aspect, the first compliance substrate is disposed between an opening of the second reservoir and an opening of the damper chamber that face each other, fixed to the second case member, and is not fixed to the first case member. Therefore, stress concentration by heat stress or the like generated between parts, for example, can be alleviated as compared with a case in which the first compliance substrate is fixed to both the first case member and the second case member.

A desirable aspect of the invention includes a case member in which the liquid reservoir is formed. The case member includes a first case member in which the first reservoir is formed, and a second case member in which the intermediate reservoir is formed. The first case member and the second case member are stacked such that at least a part of the first reservoir overlaps the second reservoir when seen in a plan view. The second case member includes an expanded space that communicates with the first reservoir on the first reservoir side and an accommodation space accommodating a driving IC which drives the driving element on the side opposite to the first reservoir. The expanded space penetrates so as to open on the accommodation space side. The first compliance substrate is fixed to the second case member so as to seal an opening which opens to the accommodation space side of the expanded space. According to this configuration, since the first compliance substrate is fixed to the second case member so as to seal the opening of the expanded space on the accommodation space side, a volume of the first reservoir can be increased by the volume of the expanded space. Since the first compliance substrate is disposed on the accommodation space side which accommodates the driving IC, for example, the metal part can be brought into contact with the driving IC when the first compliance substrate is constituted by a composite material of a flexible film and a metallic member. Since heat of the driving IC can be transmitted to the liquid via the metal part of the first compliance substrate by bringing the metal part of the first compliance substrate into contact with the driving IC, heat of the driving IC can be radiated.

In a desirable aspect of the invention, a third compliance substrate that seals an opening which opens to the first reservoir side in the first case member. In this configuration, the third compliance substrate is disposed not only in the first compliance substrate of the second case member but also in the first case member as the compliance substrate of the first reservoir. Quick pressure variation due to introduction of ink from an inlet is easily caused in the first reservoir. Therefore, quick pressure variation in the first reservoir can be accommodated effectively with an increased number of compliance substrates in the first reservoir as in this aspect.

A liquid ejection apparatus of the invention includes a transport mechanism that transports a medium, and a liquid ejection head according to any one of claims 1 to 15 that ejects a liquid onto the medium. According to the above aspect, since the first compliance substrate is provided in the first reservoir on the inlet side on the side opposite to the second reservoir, an area of an active part of the first compliance substrate can be increased irrespective of the position and the size of the inlet as compared with a case in which the compliance substrate is provided on the same side as that of the inlet. Thus, according to this aspect, an absorption effect of pressure variation caused by a liquid can be improved irrespective of the position of the inlet. Further, since the first compliance substrate is disposed in the first reservoir on the side opposite to the inlet, the first compliance substrate can be disposed such that the liquid introduced from the inlet may hit the first compliance substrate. Therefore, pressure of the liquid is transmitted to the first compliance substrate easier than a case in which the first compliance substrate is provided on the same side as that of the inlet. Therefore, pressure variation caused by the liquid introduced from the inlet is easily accommodated by the first compliance substrate. Since the second compliance substrate is provided in the second reservoir disposed on the individual channel side on the side opposite to the first reservoir, the second compliance substrate is disposed at a position closer to the pressure chamber than the first compliance substrate. Therefore, pressure variation of the pressure chamber transmitted to the second reservoir via the individual channel is effectively accommodated by the second compliance substrate. Therefore, according to this aspect, since pressure variation caused by the liquid can be effectively accommodated, ejection stability of the liquid from the nozzle can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
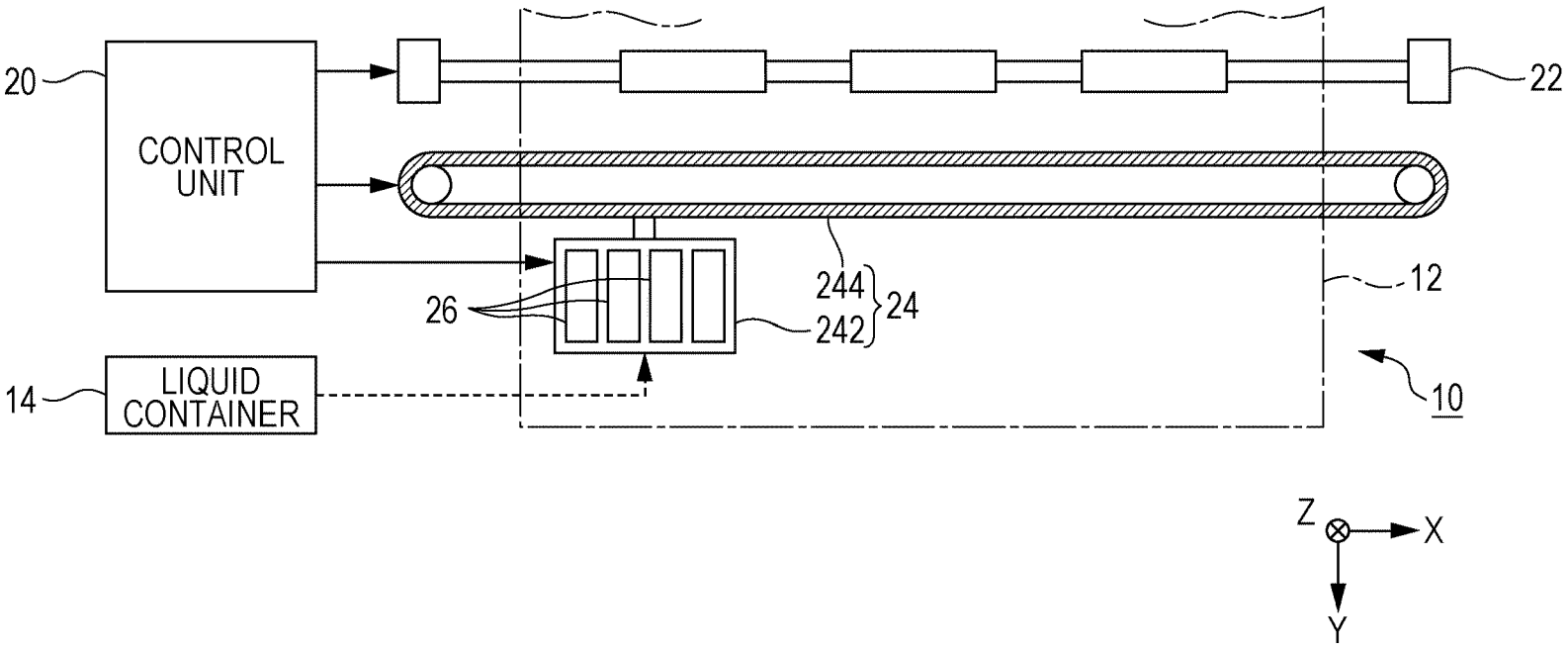
FIG. 1 is a configuration diagram of a liquid ejection apparatus according to a first embodiment of the present disclosure.

FIG. 1 is a configuration diagram illustrating a liquid ejection apparatus 10 according to a first embodiment of the invention. The liquid ejection apparatus 10 of the first embodiment is an ink jet printing apparatus which ejects ink as an exemplary liquid onto a medium 12. The medium 12 is typically printing paper, however, an arbitrary printing target, such as a resin film or a textile, may be used as the medium 12. As illustrated in FIG. 1, a liquid container 14 which stores ink is fixed to the liquid ejection apparatus 10. For example, a cartridge removably attached to the liquid ejection apparatus 10, a bag-like ink pack made of a flexible film, or an ink tank which can be replenished with ink may be used as the liquid container 14. A plurality of types of ink with different colors is stored in the liquid container 14.

As illustrated in FIG. 1, the liquid ejection apparatus 10 includes a control device 20, a transport mechanism 22, a moving mechanism 24, and a plurality of liquid ejection heads 26. The control device 20 includes a processing circuit, such as a central processing unit (CPU) or a field programmable gate array (FPGA), and a storage circuit, such as semiconductor memory, and performs centralized control of elements of the liquid ejection apparatus 10. The transport mechanism 22 transports the medium 12 in a Y direction under the control of the control device 20.

The moving mechanism 24 causes a plurality of liquid ejection heads 26 to reciprocate in an X direction under the control of the control device 20. The X direction crosses (typically, perpendicularly) the Y direction in which the medium 12 is transported. The moving mechanism 24 of the first embodiment includes a carriage 242 on which a plurality of liquid ejection heads 26 is mounted and an endless belt 244 to which the carriage 242 is fixed. It is also possible to mount the liquid container 14 on the carriage 242 together with the liquid ejection heads 26.

Each of a plurality of liquid ejection heads 26 ejects the ink supplied from the liquid container 14 onto the medium 12 from a plurality of nozzles (ejection openings) under the control of the control device 20. A desirable image is formed on a surface of the medium 12 when each liquid ejection head 26 ejects the ink onto the medium 12 while the medium 12 is transported by the transport mechanism 22 and the carriage 242 is made to reciprocate repetitively. Hereinafter, a direction orthogonal to an X-Y plane (for example, a plane parallel to a surface of the medium 12) will be defined as a Z direction. A direction in which the ink is ejected from each liquid ejection head 26 (typically the vertical direction) corresponds to the Z direction.

Figure 2:
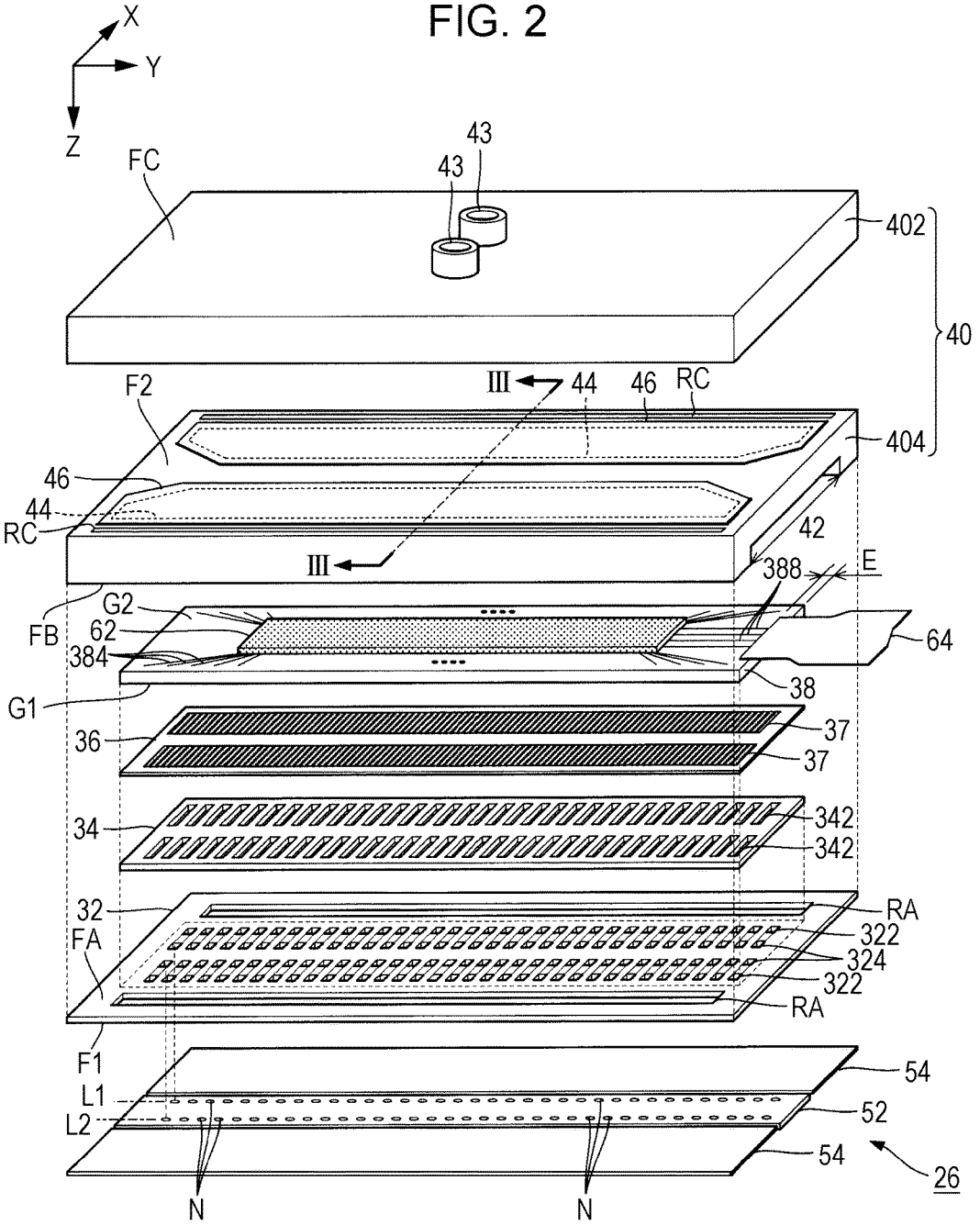
FIG. 2 is an exploded perspective view of a liquid ejection head.
Figure 3:
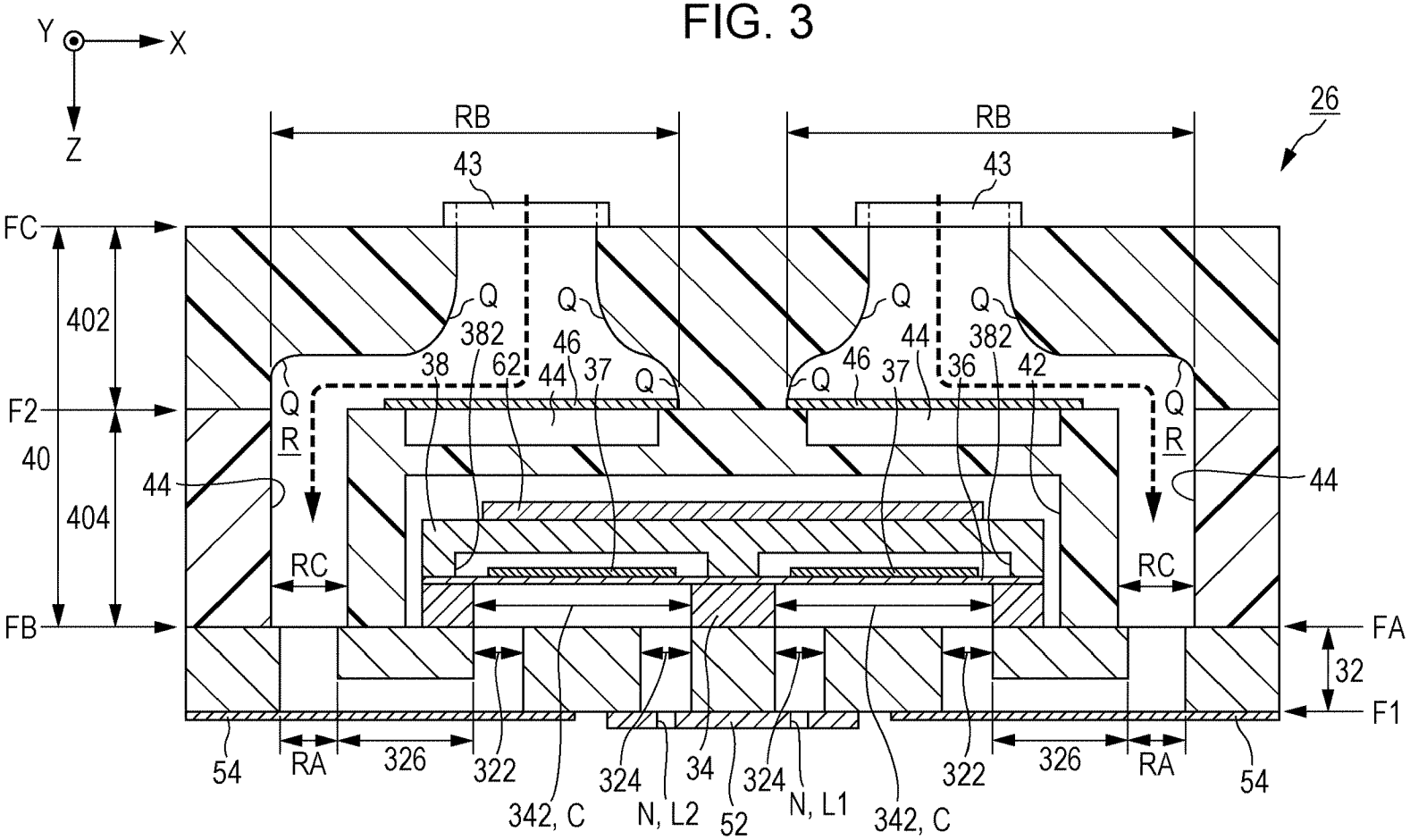
FIG. 3 is a cross-sectional view of the liquid ejection head illustrated in FIG. 2 along line III-III.
Figure 4:
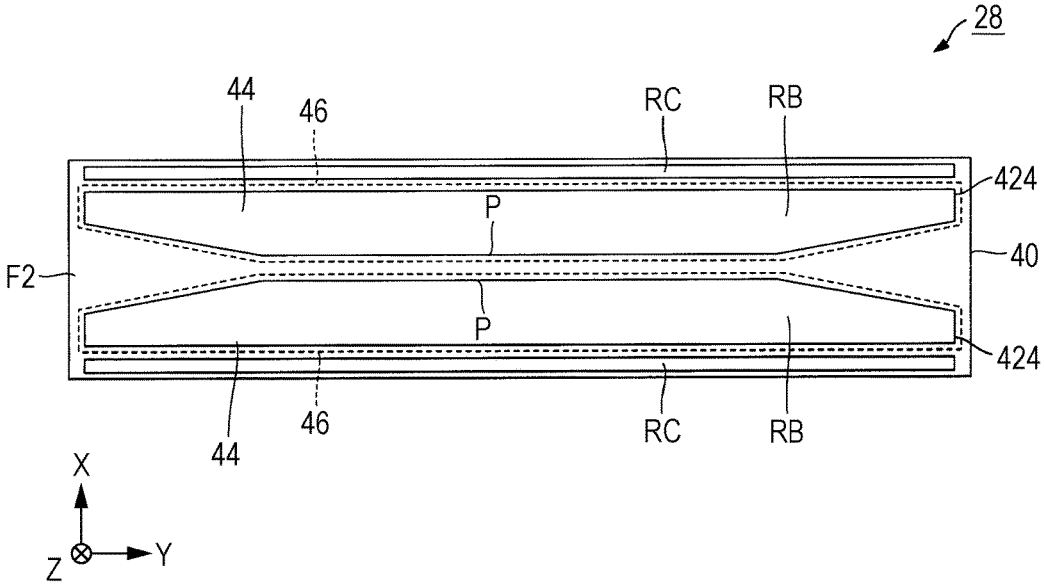
FIG. 4 is a plan view of a case member illustrated in FIG. 2 seen in a Z direction.

FIG. 2 is an exploded perspective view of one arbitrary liquid ejection head 26. FIG. 3 is a cross-sectional view along line III-III of FIG. 2. FIG. 4 is a plan view of a case member 40 illustrated in FIG. 2 seen in the Z direction. As illustrated in FIG. 2, the liquid ejection head 26 includes a plurality of nozzles N arranged in the Y direction. A plurality of nozzles N of the first embodiment is separated into a first line L1 and a second line L2. The positions of which the nozzles N are arranged in the Y direction may differ between the first line L1 and the second line L2 (that is, the nozzles N may be arranged in a zigzag or staggered pattern). However, for ease of illustration, an example in which the nozzles N of the first line L1 and the second line L2 are arranged in the same positions in the Y direction is illustrated in FIG. 3. In the liquid ejection head 26 illustrated in FIG. 2, the elements related to a plurality of nozzles N of the first line L1 and the elements related to a plurality of nozzles N of the second line L2 are arranged to be substantially linearly symmetrical.

As illustrated in FIGS. 2 and 3, the liquid ejection head 26 of the first embodiment includes a channel substrate 32. The channel substrate 32 is a tabular member which includes a first surface F1 and a bonding surface FA. The first surface F1 is a positive-side surface in the Z direction (a surface on the side of the medium 12) and the bonding surface FA is a surface on the side opposite to the first surface F1 (a negative side in the Z direction). On the bonding surface FA of the channel substrate 32, a pressure chamber substrate 34, a vibrating portion 36, a plurality of piezoelectric elements 37, a protection member 38, and a case member 40 are provided. On the first surface F1, a nozzle plate 52 and a second compliance substrate 54 are provided. Each element of the liquid ejection head 26 is a substantially tabular member which is long in the Y direction as in the channel substrate 32. The members are joined to each other by using an adhesive, for example. A direction in which the channel substrate 32, the pressure chamber substrate 34, the protection member 38, and the nozzle plate 52 are stacked may be considered the Z direction.

The nozzle plate 52 is a tabular member in which a plurality of nozzles N is formed and is attached on the first surface F1 of the channel substrate 32 by using an adhesive, for example. Each nozzle N is a through hole through which the ink passes. The nozzle plate 52 of the first embodiment is manufactured by processing a silicon (Si) monocrystal substrate by using a semiconductor manufacturing technology (for example, etching). However, publicly known materials and processes may be employed for the manufacture of the nozzle plate 52.

The channel substrate 32 is a tabular member for forming an ink channel. As illustrated in FIGS. 2 and 3, a space constituting a second reservoir RA, which is a part of a later-described liquid reservoir R, a plurality of supply channels (exemplary individual channels) 322, and a plurality of communication channels 324 are formed in the channel substrate 32 of the first embodiment for each of the first line L1 and the second line L2. The second reservoir RA is a reservoir disposed on the side of the supply channels 322 among other liquid reservoirs R and is formed in an elongated shape in the Y direction when seen in plan view (that is, when seen in the Z direction). Each of the supply channels 322 and the communication channels 324 is a through hole formed for each nozzle N. A plurality of supply channels 322 is arranged in the Y direction and a plurality of communication channels 324 is also arranged in the Y direction. As illustrated in FIG. 3, the intermediate channel 326 disposed across a plurality of supply channels 322 is formed on the first surface F1 of the channel substrate 32. The intermediate flow channel 326 connects the second reservoir RA and a plurality of supply channels 322 to each other. The communication channel 324 communicates with the nozzle N.

As illustrated in FIGS. 2 and 3, the pressure chamber substrate 34 is a tabular member of which a plurality of openings 342 arranged in the Y direction is formed for each of the first line L1 and the second line L2. The pressure chamber substrate 34 is attached on the bonding surface FA of the channel substrate 32 by using an adhesive, for example. The opening 342 is an elongated through hole which is formed in every nozzle N in the X direction when seen in a plan view. The channel substrate 32 and the pressure chamber substrate 34 are manufactured by processing a silicon (Si) monocrystal substrate by using a semiconductor manufacturing technology, for example, as in the above-described nozzle plate 52. However, publicly known materials and processes may be employed for the manufacture of the channel substrate 32 and the pressure chamber substrate 34.

As illustrated in FIGS. 2 and 3, a vibrating portion 36 is provided on the surface of the pressure chamber substrate 34 on the side opposite to the channel substrate 32. The vibrating portion 36 of the first embodiment is a tabular member which vibrates elastically (a vibrating plate). The pressure chamber substrate 34 and the vibrating portion 36 may be integrated with each other by selectively removing a part of a tabular member of a predetermined thickness in a thickness direction in an area corresponding to the opening 342.

As is understood from FIG. 3, the bonding surface FA of the channel substrate 32 and the vibrating portion 36 face each other with a space inside of each opening 342 therebetween. A space between the bonding surface FA of the channel substrate 32 and the vibrating portion 36 inside of the opening 342 functions as a pressure chamber C for applying pressure to the ink with which the space is filled. The longitudinal direction of the pressure chamber C corresponds to the X direction, and the width direction of the pressure chamber C corresponds to the Y direction, for example. A pressure chamber C is formed for each nozzle N. A plurality of pressure chambers C is arranged in the Y direction for each of the first line L1 and the second line L2. As is understood from FIG. 3, each pressure chamber C communicates with a respective second reservoir RA via a respective supply channel 322 and a respective intermediate flow channel 326, and communicates with a respective nozzle N via a respective communication channel 324. It is also possible to add predetermined channel resistance by forming a narrowed channel having a narrowed flow path width in the opening 342.

As illustrated in FIGS. 2 and 3, a plurality of piezoelectric elements 37 corresponding to different nozzles N is provided for each of the first line L1 and the second line L2 on a surface of the vibrating portion 36 on the side opposite to the pressure chamber C. The piezoelectric elements 37 are driving elements which deform upon receiving a driving signal. A plurality of piezoelectric elements 37 is arranged in the Y direction so as to correspond to the pressure chambers C. Each piezoelectric element 37 is a layered product in which a piezoelectric member is disposed between mutually facing electrodes. When the vibrating portion 36 is vibrated in accordance with deformation of the piezoelectric element 37, a pressure fluctuation is caused in the pressure chamber C, and the ink with which the pressure chamber C is filled passes through the communication channel 324 and the nozzle N and is ejected.

The protection member 38 of FIGS. 2 and 3 is a tabular member for protecting a plurality of piezoelectric elements 37 and is provided on the surface of the vibrating portion 36 (or the surface of the pressure chamber substrate 34). The protection member 38 may be made of an non-specific material and by an non-specific process. The protection member 38 may be formed by processing a silicon (Si)

monocrystal substrate by using a semiconductor manufacturing technology, for example, as in the channel substrate 32 or the pressure chamber substrate 34.

An accommodation space 382 which accommodates a plurality of piezoelectric elements 37 is formed on a surface of the protection member 38 on the side of the vibrating portion 36 (hereinafter, a "bonding surface") for each of the first line L1 and the second line L2. The accommodation space 382 is a space depressed from the bonding surface and is long in the Y direction along the array of a plurality of piezoelectric elements 37. A driving IC 62 is provided on a surface of the protection member 38 opposite to the side of the accommodation space 382 (hereinafter, a "mounting surface"). The driving IC 62 is a substantially rectangular IC chip on which a driving circuit which drives each piezoelectric element 37 by generating and supplying a driving signal under the control of the control device 20 is mounted. As illustrated in FIG. 3, at least some of the piezoelectric elements 37 of the liquid ejection head 26 overlap the driving IC 62 when seen in plan view. As illustrated in FIG. 3, the driving IC 62 overlaps both the piezoelectric elements 37 corresponding to the nozzles N of the first line L1 and the piezoelectric elements 37 corresponding to the nozzles N of the second line L2 when seen in plan view. That is, the driving IC 62 is disposed across both the nozzles N of the first line L1 and the nozzles N of the second line L2 in the X direction.

As illustrated in FIG. 2, a plurality of wires 388 connected to an input terminal of the driving IC 62 is formed on the mounting surface of the protection member 38. A plurality of wires 388 extends to a region E positioned at an end of the mounting surface of the protection member 38 in the Y direction (that is, a direction in which a plurality of piezoelectric elements 37 is arranged). A wiring member 64 is connected to the region E of the mounting surface. The wiring member 64 is a mounting component in which a plurality of wires (not illustrated) which electrically connects the control device 20 and the driving IC 62 to each other is formed. For example, a flexible wiring substrate, such as a flexible printed circuit (FPC) or a flexible flat cable (FFC), is suitably employed as the wiring member 64. As described above, the protection member 38 of the first embodiment functions also as a wiring substrate in which the wires (384 and 388) which transmit the driving signals are formed. A wiring substrate to be used for mounting of the driving IC 62 or the formation of the wires may be provided separately from the protection member 38.

A case member (a case portion) 40 in FIGS. 2 and 3 is constituted by a first case member (an upper case member) 402 and a second case member (a lower case member) 404 which are stacked together. The first case member 402 is disposed on a negative side (an upper side) in the Z direction and the second case member 404 is disposed on a positive side (a lower side) in the Z direction. The first case member 402 and the second case member 404 are joined to each other by using an adhesive. The case member 40 is a housing for storing the ink to be supplied to a plurality of pressure chambers C (and a plurality of nozzles N). A surface of the second case member 404 on the positive side in the Z direction (hereinafter, a "bonding surface") FB is fixed to the bonding surface FA of the channel substrate 32 by using an adhesive, for example. As illustrated in FIGS. 2 and 3, a groove-shaped recess 42 extending in the Y direction is formed on the bonding surface FB of the second case member 404. The protection member 38 and the driving IC 62 are contained in an accommodation space inside the recess 42. The wiring member 64 joined to the region E of the protection member 38 extends in the Y direction so as to pass through the inside of the recess 42.

The case member 40 of the first embodiment is made of a material different from that of the channel substrate 32 and the pressure chamber substrate 34. For example, the case member 40 may be made of an injection molded resin material. However, publicly known materials and processes may be employed for the manufacture of the case member 40. For example, synthetic fiber and resin materials may be desirably used as the material of the case member 40.

As illustrated in FIGS. 3 and 4, in the first embodiment, a space which constitutes a first reservoir RB is formed in the first case member 402 for each of the first line L1 and the second line L2, and a space which constitutes an intermediate reservoir RC is formed in the second case member 404. The first reservoir RB of the first case member 402 and the second reservoir RA of the channel substrate 32 communicate with each other via the intermediate reservoir RC of the second case member 404. The space constituted by the second reservoir RA, the first reservoir RB, and the intermediate reservoir RC functions as a liquid reservoir (a reservoir) R which stores ink to be supplied to a plurality of pressure chambers C. The liquid reservoir R is a common liquid chamber across a plurality of nozzles N. An inlet 43 for introducing ink supplied from the liquid container 14 into the liquid reservoir R is formed on the surface FC of the first case member 402 on the side opposite to the channel substrate 32 for each of the first line L1 and the second line L2. The surface of the second case member 404 on the side opposite to the channel substrate 32 is defined as a second surface F2.

As illustrated in FIG. 3, the first reservoir RB of the first case member 402 is a space which is long in the Y direction. The first reservoir RB communicates with the inlet 43. The intermediate reservoir RC of the second case member 404 is a space which is long in the Z direction. The intermediate reservoir RC is positioned on a downstream side of the first reservoir RB, and communicates with the second reservoir RA of the channel substrate 32. When seen from a positive side in the Z direction, the recess 42 which accommodates the protection member 38 and the driving IC 62 is positioned between the intermediate reservoir RC corresponding to the first line L1 and the intermediate reservoir RC corresponding to the second line L2. Therefore, the intermediate reservoir RC is positioned on the side (a positive side or a negative side in the X direction) of the piezoelectric element 37, the protection member 38, and the driving IC 62. As described above, in the first embodiment, the liquid reservoir R includes the first reservoir RB and the intermediate reservoir RC. Therefore, compared with a configuration without either the first reservoir RB or the intermediate reservoir RC, it is possible to increase the size of the liquid reservoir R.

The ink supplied to the inlet 43 along the positive side in the Z direction from the liquid container 14 flows inside the first reservoir RB of the liquid reservoir R in the direction substantially parallel to an X-Y plane (for example, horizontal direction, X direction) depicted by broken line arrow in FIG. 3 and flows into the intermediate reservoir RC then flows on the positive side (for example, at a lower side in the vertical direction) in the Z direction inside the intermediate reservoir RC and reaches the second reservoir RA of the channel substrate 32. The ink stored in the liquid reservoir R flows in the X direction in the intermediate channel 326, branches from the intermediate channel 326 into a plurality of supply channels 322, flows toward the negative side of the Z direction, and is supplied to each pressure chamber C in parallel to fill each pressure chamber C. The ink with which the pressure chamber C is filled flows in the Z direction in the communication channel 324 and is ejected through the nozzles N.

Each of the liquid ejection heads 26 of the first embodiment includes the first surface F1 and the second surface F2 as described above. Each piezoelectric element 37, the protection member 38, and the driving IC 62 are disposed between the first surface F1 and the second surface F2. The first surface F1 is positioned on the piezoelectric element 37 side when seen from the driving IC 62, and the second surface F2 is positioned on the side opposite to the piezoelectric element 37 when seen from the driving IC 62. The above-described inlet 43 is formed on the second surface F2.

As illustrated in FIG. 2, the second compliance substrate 54 is provided on the first surface F1 of the channel substrate 32. The second compliance substrate 54 is a flexible film which accommodates pressure variation of the ink in the liquid reservoir R. As illustrated in FIG. 3, the second compliance substrate 54 is disposed on the first surface F1 of the channel substrate 32, and constitutes a wall surface (specifically, a bottom surface of the second reservoir RA) of the liquid reservoir R so as to seal the opening which opens to the first surface F1 of the channel substrate 32 by the second reservoir RA, the intermediate flow channel 326, and a plurality of supply channels 322 of the channel substrate 32. Since the second compliance substrate 54 of such a configuration is disposed at a position close to the pressure chamber C, the second compliance substrate 54 can effectively accommodate pressure variation of the pressure chamber C transmitted to the second reservoir RA via the supply channels 322 as which are individual channels.

The first compliance substrate 46 is provided on the second surface F2 of the second case member 404. The first compliance substrate 46 is a flexible film which accommodates pressure variation of the ink in the liquid reservoir R as in the second compliance substrate 54. As illustrated in FIG. 3, an opening which constitutes a damper chamber 44 is provided in the second case member 404 on the side opposite to the first reservoir RB via the first compliance substrate 46. The first compliance substrate 46 is provided on the second surface F2 and constitutes a wall surface (specifically, a bottom surface of the first reservoir RB) of the liquid reservoir R so as to seal the opening of the damper chamber 44. According to this configuration, with the pressure in the direction in which the ink flows into the first reservoir RB from the inlet 43, the first compliance substrate 46 can be bent toward the damper chamber 44. Therefore, the pressure variation of the ink which flows into the first reservoir RB from the inlet 43 can be controlled effectively. Since it is easy to provide a sufficient area for the second surface F2, according to the first embodiment in which the first compliance substrate 46 is disposed on the second surface F2 of the channel substrate 32, pressure variation in the liquid reservoir R is effectively accommodatable as compared with the configuration in which only the second compliance substrate 54 is provided.

As illustrated in FIG. 3, at least a part of the first reservoir RB overlaps the second reservoir RA when seen in plan view (that is, when seen in the Z direction). Further, at least a part of the first compliance substrate 46 overlaps the second compliance substrate 54 when seen in plan view. The pressure chamber C overlaps both the first reservoir RB and the first compliance substrate 46 when seen in plan view. It is also considered that the first reservoir RB protrudes from the intermediate reservoir RC in the X direction so as to overlap the piezoelectric element 37 and the driving IC 62, and the first compliance substrate 46 is provided in the protruding portion. Therefore, since each constituent element of the liquid ejection head 26 is made to overlap as much as possible when seen in plan view, the size of the liquid ejection head 26 can be reduced as much as possible.

Since the first compliance substrate 46 of the present embodiment is provided in the first reservoir RB on the second reservoir RA side which is the side opposite to that of the inlet 43, an area of an active part in which the first compliance substrate 46 deforms can be increased irrespective of the position and the size of the inlet 43 as compared with the case in which the compliance substrate 46 is provided on the same side as that of the inlet 43.

Figure 5:
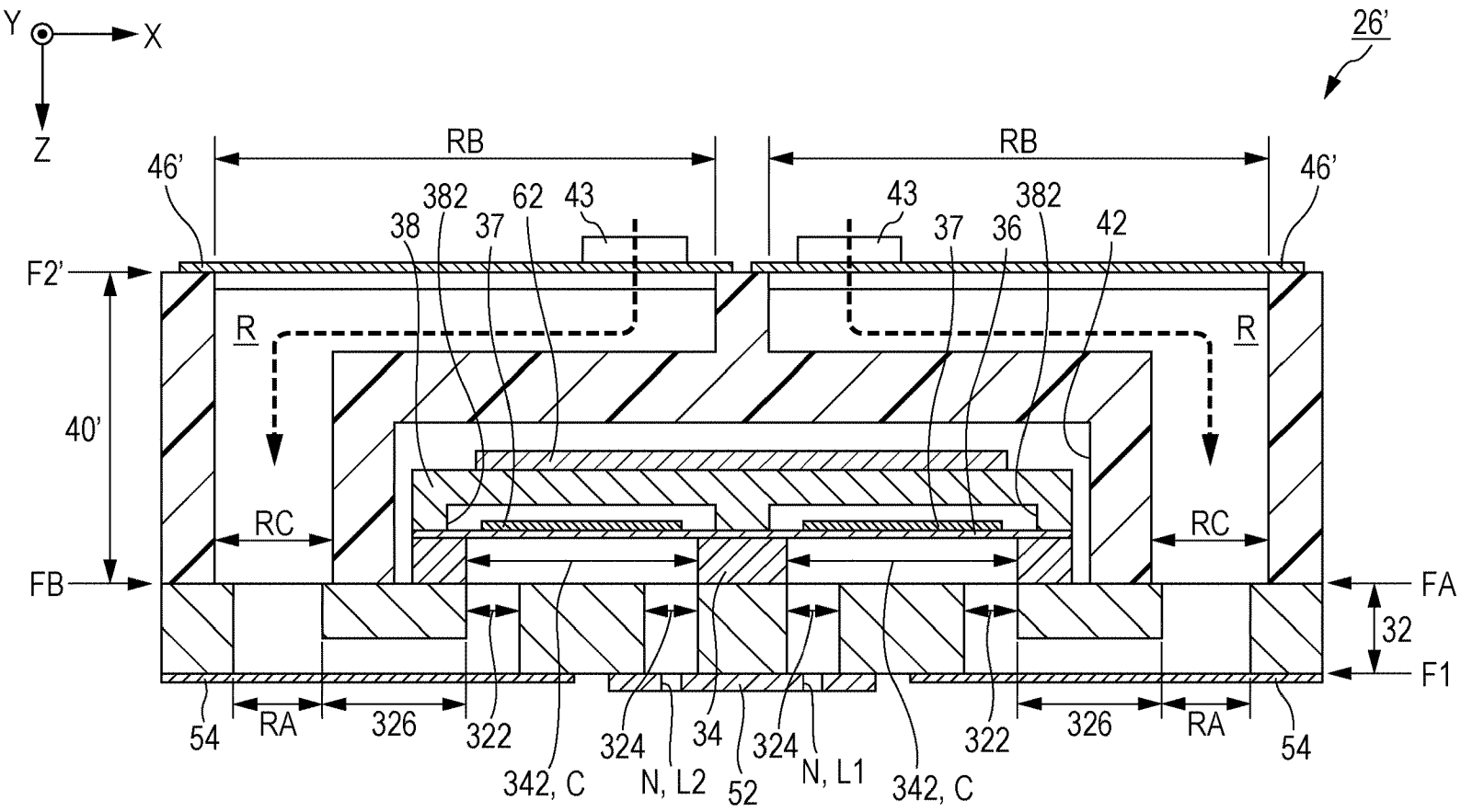
FIG. 5 is a cross-sectional view of a liquid ejection head according to Comparative Example.
Figure 6:
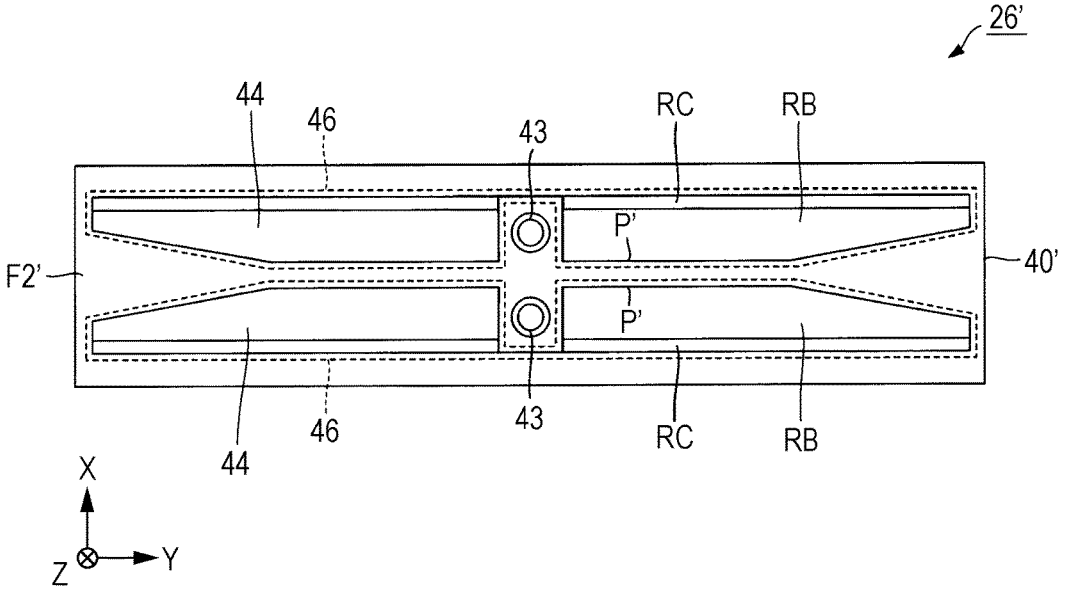
FIG. 6 is a plan view of a case member according to Comparative Example seen in the Z direction.

Here, an operation and effect of the present embodiment will be described in comparison with Comparative Example. FIG. 5 is a cross-sectional view of a liquid ejection head 26' according to Comparative Example of the present embodiment and corresponds to FIG. 3. FIG. 6 is a plan view of a case member 40' of Comparative Example illustrated in FIG. 5 seen in the Z direction. As illustrated in FIGS. 5 and 6, in the liquid ejection head 26' of Comparative Example, a compliance substrate 46' is provided on the same side as that of the inlet 43. That is, in the liquid ejection head 26' of Comparative Example, an inlet 43 and a first reservoir RB are provided in the case member 40', and the compliance substrate 46' is provided on a second surface F2' of the same side as that of the inlet 43 in the case member 40'. In the configuration of Comparative Example, since the compliance substrate 46' is provided on the same side as that of the inlet 43, an active part of the compliance substrate 46' needs to be disposed so as not to interfere with the inlet 43 so that a metal part of the inlet 43 is not deformed. Therefore, an area and a form of the active part of the compliance substrate 46' will be limited by the position and the size of the inlet 43.

In the liquid ejection head 26 of the present embodiment, the case member 40 is formed by the first case member 402 and the second case member 404, and the inlet 43 is provided on the side of the first case member 402. According to this configuration, the first reservoir RB and the compliance substrate 46 can be provided on the side of the first case member 402 separately from the inlet 43. Therefore, in the present embodiment, an area of the active part of the first compliance substrate 46 can be increased irrespective of the position and the size of the inlet 43.

A portion depicted by the dotted line in FIG. 4 corresponds to the first compliance substrate 46 of the present embodiment, and a portion depicted by the solid line inside thereof is equivalent to the active part P. Similarly, a portion depicted by the dotted line in FIG. 6 corresponds to the first compliance substrate 46' of Comparative Example, and a portion depicted by the solid line inside thereof is equivalent to an active part P'. In the first compliance substrate 46' of Comparative Example of FIG. 6, a portion in which the inlet 43 is disposed cannot function as an active part. On the contrary, since there is no portion in which the inlet 43 is disposed in the first compliance substrate 46 of the present embodiment of FIG. 4, the active part P of the first compliance substrate 46 is larger than the active part P' of Comparative Example of FIG. 6. Therefore, according to the first compliance substrate 46 of the present embodiment, an absorption effect of the pressure variation by the ink can be improved irrespective of the position of the inlet 43.

In the configuration of the present embodiment illustrated in FIG. 3, since the first compliance substrate 46 is disposed in the first reservoir RB on the side opposite to the inlet 43, the first compliance substrate 46 can be disposed such that the ink introduced from the inlet 43 may hit the first compliance substrate 46. Therefore, the pressure of the ink is more easily transmitted to the first compliance substrate 46 than in a case in which the first compliance substrate 46' is disposed on the same side as that of the inlet 43 like Comparative Example illustrated in FIG. 5. Therefore, pressure variation caused by the ink introduced from the inlet 43 is easily accommodated by the first compliance substrate 46.

Next, a relationship between the first compliance substrate 46 and the second compliance substrate 54 will be described. In the present embodiment, in the second reservoir RA disposed on the supply channel 322 side which is an individual channel, the second compliance substrate 54 is provided on the side opposite to the first reservoir RB. Therefore, the second compliance substrate 54 is disposed at a position closer to the pressure chamber C than the first compliance substrate 46. Therefore, pressure variation of the pressure chamber C transmitted to the second reservoir RA via the supply channel 322 is effectively accommodated by the second compliance substrate 54.

According to the present embodiment, the pressure variation caused by introduction of the ink from the inlet 43 is easily accommodated mainly by the first compliance substrate 46, and the pressure variation of the pressure chamber C is easily accommodated mainly by the second compliance substrate 54. For example, by setting the Young's modulus of the second compliance substrate 54 to be equal to or smaller than the Young's modulus of the first compliance substrate 46, the second compliance substrate 54 can be made softer (less rigid) than the first compliance substrate 46. In this manner, the pressure variation of the pressure chamber C which is minuter than the pressure variation caused by introduction of the ink from the inlet 43 can be more easily accommodated by the second compliance substrate 54.

Regarding the first compliance substrate 46, pressure variation (pressure loss) caused by a quick movement of the ink in the first reservoir RB introduced from the inlet 43 is accommodatable by the active part of the first compliance substrate 46 which moves greatly and changes channel volume. Therefore, the first compliance substrate 46 is desirably made of a material and in a size to be bent greater than the second compliance substrate 54. The second compliance substrate 54 can be made softer than the first compliance substrate 46 by setting a thickness of the second compliance substrate 54 to be equal to or smaller than a thickness of the first compliance substrate 46. Also in this manner, the pressure variation of the pressure chamber C may be easily accommodated by the second compliance substrate 54.

As described above, since the two compliance substrates are disposed in the present embodiment, the optimal material and size may be selected for each of the compliance substrates. In addition to those described above, materials having metal evaporated film to suppress transmission of moisture content may be employed as the material of the first compliance substrate, for example. Since the pressure variation of the liquid reservoir R may become larger in a certain pressure range in a case in which printing is performed from a non-printing condition to the maximum printing speed, for example, the material of the first compliance substrate 46 may have a different bending amount depending on the pressure range.

In the present embodiment, the case member 40 is divided into the first case member 402 and the second case member 404, and the first reservoir RB is formed in the first case member 402 which is disposed on the upper side. Therefore, by forming the first case member 402 by a material which is easy to process, the shape of a ceiling of the first reservoir RB can be easily changed.

Dischargeability of air bubbles which easily move upward can be improved by forming the shape of a corner Q of the ceiling of the first reservoir RB into a curved surface shape along a flow of the ink, and the like, as illustrated in FIG. 3, for example. Since a flow velocity of ink necessary for the discharge of air bubbles can be lowered by improving dischargeability of air bubbles, waste of ink can be reduced. Since the first case member 402 and the second case member 404 are divided, a first reservoir RB of a different shape or a first reservoir RB having different functions (a function for circulating the ink, and a function for removing air bubbles), for example, may be used easily by simply replacing the first case member 402.

In the present embodiment, since the first compliance substrate 46 is provided between the first case member 402 and the second case member 404, the active part P of the first compliance substrate 46 is not exposed to the outside of the first case member 402 and the second case member 404. Therefore, as compared with a case in which the first compliance substrate 46 is exposed to the outside of the first case member 402 and the second case member 404, evaporation of moisture content can be suppressed, and it is easy to take measures to suppress evaporation of moisture content. As measures to suppress evaporation of moisture content, for example, it is also possible to seal the first compliance substrate 46 after providing a long air channel for suppressing internal pressure fluctuation caused by temperature change.

The length of the first compliance substrate 46 is longer than an opening width of the inlet 43 not only in the Y direction (the longitudinal direction) but also in the X direction (the width direction). Therefore, since the area of the active part becomes larger than the opening width of the inlet 43, deformation of the active part can be made larger. Therefore, pressure variation of the ink is more easily accommodated by the first compliance substrate 46. Since the first compliance substrate 46 overlaps the inlet 43 when seen in a plan view, the ink introduced from the inlet 43 easily hits the first compliance substrate 46. Therefore, pressure of the ink is easily transmitted to the first compliance substrate 46, and the pressure variation caused by the ink introduced from the inlet 43 is more easily accommodated by the first compliance substrate 46.

Since the first compliance substrate 46 of the present embodiment is provided between the first case member 402 and the second case member 404, the first compliance substrate 46 can be formed by a single member containing no metal, such as a flexible film, like film. The first compliance substrate 46 may be formed by a member which contains a metal evaporated film as a flexible film. Although a case in which two openings which constitute two damper chambers 44 are sealed by separate first compliance substrates 46, respectively, is described in the present embodiment, the invention it is not limited to the same, and two openings which constitute the damper chambers 44 may be sealed by a single first compliance substrate 46. In the present embodiment, since the first compliance substrate 46 is disposed in the first reservoir RB on the side opposite to the inlet 43, the first compliance substrate 46 can be formed separately from the inlet 43. Therefore, it is not necessary to provide rigidity to the first compliance substrate 46 itself by integrating the metallic member which forms the inlet 43 and the first compliance substrate 46 as a component module. Therefore, by setting the first compliance substrate 46 as a single part, the number of parts can be reduced. However, the first compliance substrate 46 itself may have rigidity as a composite member with the flexible film and the metallic member.

The first compliance substrate 46 may be fixed to both the first case member 402 and the second case member 404, or only to one of them. For example, the first compliance substrate 46 may be fixed to the second case member 404, and may not be fixed to the first case member 402. According to this configuration, stress concentration by heat stress or the like generated between parts, for example, can be alleviated as compared with a case in which the first compliance substrate 46 is fixed to both the first case member 402 and the second case member 404.

Second Embodiment

Figure 7:
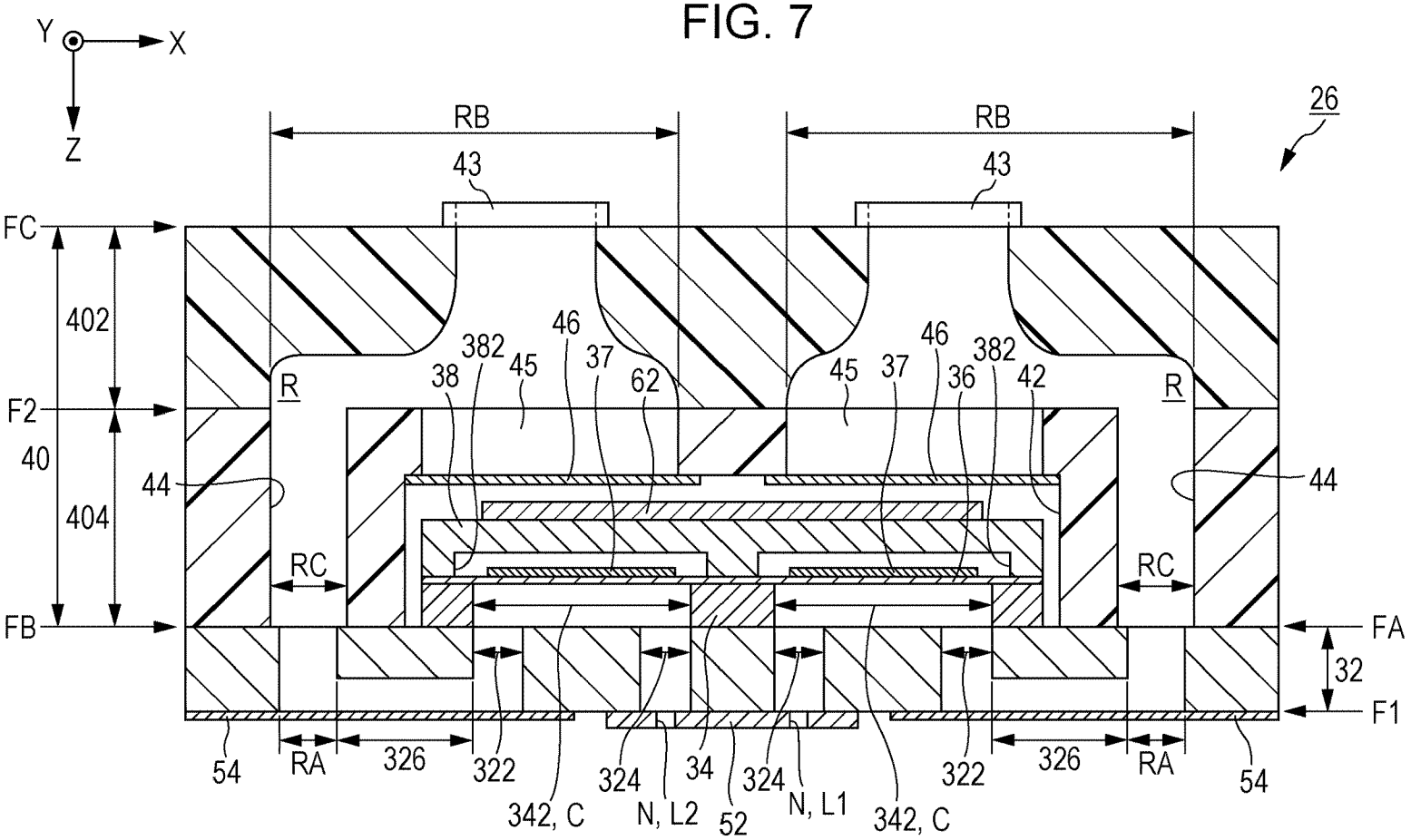
FIG. 7 is a cross-sectional view of a liquid ejection head according to a second embodiment.

A second embodiment of the invention will be described. In each form described below, elements having the same effects and functions as those of the first embodiment are denoted by the same reference numerals used in the description of the first embodiment, and detailed description will be omitted. In the first embodiment, the first compliance substrate 46 is disposed between the first case member 402 and the second case member 404. In the second embodiment, a first compliance substrate 46 is disposed in another position. FIG. 7 is a cross-sectional view of a liquid ejection head 26 of the second embodiment and corresponds to FIG. 3. A second case member 404 of FIG. 7 includes an expanded space 45 which communicates with a first reservoir RB on a first reservoir RB side. The second case member 404 of FIG. 7 includes an accommodation space which is constituted by a recess 42 accommodating a driving IC on the side opposite to the first reservoir RB as in FIG. 3. The expanded space 45 penetrates so as to open to the accommodation space (the recess 42). The first compliance substrate 46 of FIG. 7 is fixed to the second case member 404 so as to seal an opening of the expanded space 45 which opens to the accommodation space side.

According to the configuration of the second embodiment, since the first compliance substrate 46 is fixed to the second case member 404 from the inside of the recess 42 so as to seal the opening of the expanded space 45 on the accommodation space side, a volume of the first reservoir RB can be increased by the volume of the expanded space 45.

Third Embodiment

Figure 8:
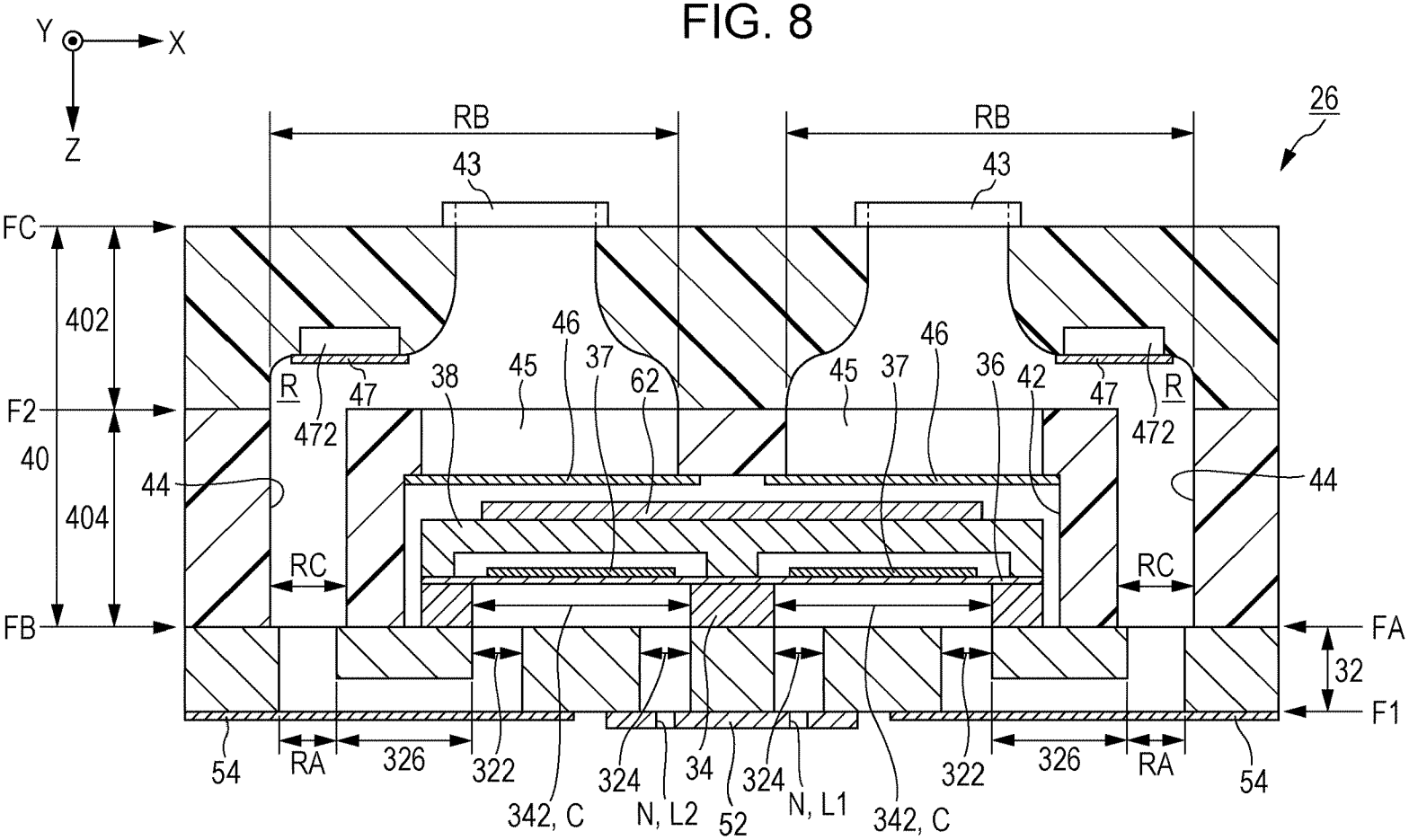
FIG. 8 is a cross-sectional view of a liquid ejection head according to a third embodiment.

A third embodiment of the invention will be described. In the third embodiment, a plurality of first compliance substrates 46 is provided in a first reservoir RB. FIG. 8 is a cross-sectional view of a liquid ejection head 26 of a third embodiment and corresponds to FIG. 7. FIG. 8 illustrates a liquid ejection head 26 in which a third compliance substrate 47 which seals an opening (a damper chamber) 472 which opens to the first reservoir RB side is also provided in a first case member 402, other than a first compliance substrate 46 illustrated in FIG. 7.

According to the configuration of the third embodiment, the third compliance substrate 47 as the compliance substrate of the first reservoir RB is disposed not only in the first compliance substrate 46 of the second case member 404 but also in the first case member 402. Quick pressure variation due to introduction of ink from an inlet 43 is easily caused in the first reservoir RB. Therefore, quick pressure variation in the first reservoir RB can be accommodated effectively with an increased number of compliance substrates in the first reservoir RB as in the third embodiment. The compliance substrates in the first reservoir RB are not limited to the first compliance substrate 46 and the third compliance substrate 47 described in the third embodiment, and further compliance substrates may be provided.

ALTERNATIVE EMBODIMENTS

The aspects and embodiments described above may be modified in various ways. Aspects of specific alternative embodiments will be described below. Two or more aspects arbitrarily selected from the following examples and above-described aspects may be merged suitably in a range without contradiction.

(1) In the embodiments described above, a serial head in which the carriage 242 on which the liquid ejection heads 26 are mounted is made to repetitively reciprocate in the X direction is described. However, the invention is applicable also to a linear head in which the liquid ejection heads 26 are arranged over the entire width of the medium 12.

(2) In the embodiments described above, a piezoelectric system liquid ejection head 26 using a piezoelectric element which applies mechanical vibration to a pressure chamber is described. However, a thermal system liquid ejection head using a heating element which generates air bubbles inside a pressure chamber may also be employed.

(3) The liquid ejection apparatus 10 described in each of the above-described embodiments is applicable to an apparatus dedicated for printing, and other various apparatuses, such as a facsimile machine and a copy machine.

However, application of the liquid ejection apparatus 10 of the invention is not limited to printing. For example, the liquid ejection apparatus which ejects a solution of a coloring material is used as an apparatus for manufacturing a color filter of a liquid crystal display device, an organic electro luminescence (EL) display, a surface emitting display (FED), and so forth. A liquid ejection apparatus which ejects a solution of a conductive material may be used as an apparatus for manufacturing a wire and an electrode of a wiring substrate. Further, the liquid ejection apparatus is used as a chip manufacturing apparatus which ejects a solution of bioorganic substances as a kind of the liquid.

What is claimed is:

1. A liquid ejection head, comprising:

a driving element that changes a pressure of a pressure chamber and causes a liquid to be ejected from a nozzle;

an individual channel that communicates with the pressure chamber; and a liquid reservoir that supplies, via the individual channel, the liquid introduced from an inlet to the pressure chamber, wherein the liquid reservoir includes a first reservoir disposed on the inlet side, a second reservoir disposed on the individual channel side, and an intermediate reservoir that communicates with the first reservoir and the second reservoir, at least a part of the first reservoir overlaps the second reservoir when seen in plan view, a first compliance substrate is provided in the first reservoir on the second reservoir side on the side opposite to the inlet, and a second compliance substrate is provided in the second reservoir on the side opposite to the first reservoir.

2. A liquid ejection apparatus, comprising:

a transport mechanism that transports a medium; and a liquid ejection head according to claim 1 that ejects a liquid onto the medium.

3. The liquid ejection head according to claim 1, wherein at least a part of the first compliance substrate overlaps the second compliance substrate when seen in plan view.

4. A liquid ejection apparatus, comprising:

a transport mechanism that transports a medium; and a liquid ejection head according to claim 2 that ejects a liquid onto the medium.

5. The liquid ejection head according to claim 1, wherein Young's modulus of the second compliance substrate is equal to or lower than Young's modulus of the first compliance substrate.

6. A liquid ejection apparatus, comprising:

a transport mechanism that transports a medium; and a liquid ejection head according to claim 5 that ejects a liquid onto the medium.

7. The liquid ejection head according to claim 1, wherein a thickness of the second compliance substrate is equal to or smaller than a thickness of the first compliance substrate.

8. A liquid ejection apparatus, comprising:

a transport mechanism that transports a medium; and a liquid ejection head according to claim 7 that ejects a liquid onto the medium.

9. The liquid ejection head according to claim 1, wherein the pressure chamber overlaps both the first reservoir and the first compliance substrate when seen in plan view.

10. A liquid ejection apparatus, comprising:

a transport mechanism that transports a medium; and a liquid ejection head according to claim 9 that ejects a liquid onto the medium.

11. The liquid ejection head according to claim 1, further comprising a driving IC that drives the driving element, wherein the driving IC overlaps both the pressure chamber and the first compliance substrate when seen in plan view.

12. The liquid ejection head according to claim 1, further comprising a case member in which the liquid reservoir is formed, wherein the case member includes a first case member in which the first reservoir is formed, and a second case member in which the intermediate reservoir is formed, the first case member and the second case member are stacked such that at least a part of the first reservoir overlaps the second reservoir when seen in plan view, and the first compliance substrate is provided between the first case member and the second case member.

13. The liquid ejection head according to claim 12, wherein a damper chamber is provided in the second case member on the side opposite to the first reservoir via the first compliance substrate.

14. The liquid ejection head according to claim 13, wherein the length of an active part of the first compliance substrate which is to be deformed is longer than an opening width of the inlet.

15. The liquid ejection head according to claim 14, wherein the first compliance substrate overlaps the inlet when seen in plan view.

16. The liquid ejection head according to claim 13, wherein the first compliance substrate is a composite of a flexible film and a metallic member.

17. The liquid ejection head according to claim 13, wherein the first compliance substrate is a single member containing no metallic member.

18. The liquid ejection head according to claim 13, wherein the first compliance substrate is disposed between an opening of the second reservoir and an opening of the damper chamber that face each other, fixed to the second case member, and is not fixed to the first case member.

19. The liquid ejection head according to claim 1, further comprising a case member in which the liquid reservoir is formed, wherein the case member includes a first case member in which the first reservoir is formed, and a second case member in which the intermediate reservoir is formed, the first case member and the second case member are stacked such that at least a part of the first reservoir overlaps the second reservoir when seen in plan view, the second case member includes an expanded space that communicates with the first reservoir on the first reservoir side and an accommodation space accommodating a driving IC which drives the driving element on the side opposite to the first reservoir, the expanded space extends so as to open on the accommodation space side, and the first compliance substrate is fixed to the second case member so as to seal an opening which opens to the accommodation space side of the expanded space.

20. The liquid ejection head according to claim 19, further comprising a third compliance substrate that seals an opening which opens to the first reservoir side in the first case member.

* * * * *